United States Patent [19]

Nakano et al.

[11] Patent Number: 4,615,268

[45] Date of Patent: Oct. 7, 1986

[54] REMOTE BLASTING SYSTEM FOR EFFECTING MULTIPLE-STEP EXPLOSION AND SWITCHING UNIT FOR USE IN THIS SYSTEM

[75] Inventors: Masashi Nakano; Takeo Ueda, both of Aichi, Japan

[73] Assignee: Nippon Oil and Fats Company Limited, Tokyo, Japan

[21] Appl. No.: 671,212

[22] Filed: Nov. 14, 1984

[30] Foreign Application Priority Data

Nov. 22, 1983 [JP] Japan ..... 58-220135

[51] Int. Cl.[4] ..... F42C 11/00

[52] U.S. Cl. ..... 102/217; 102/200

[58] Field of Search ..... 102/217, 218, 219, 220, 102/206, 200, 301; 200/52 R, 61.08

[56] References Cited

U.S. PATENT DOCUMENTS

| | | | |
|---|---|---|---|
| 2,725,822 | 12/1955 | Janelid | 102/217 |
| 3,170,399 | 2/1965 | Hinman, Jr. | 102/219 |
| 3,834,310 | 9/1974 | Ueda et al. | 102/220 |
| 4,099,467 | 7/1978 | MacKellar et al. | 102/217 |
| 4,145,970 | 3/1979 | Hedberg et al. | 102/218 |
| 4,489,655 | 12/1984 | Molnar | 102/217 |

*Primary Examiner*—Charles T. Jordan

*Attorney, Agent, or Firm*—Parkhurst & Oliff

[57] ABSTRACT

A remote blasting system for exploding a number of explosives in a multiple-step manner including an oscillating unit for radiating an electromagnetic wave due to which A.C. currents are induced in receiving units some of which are directly connected to detonators and the remaining receiving units being connected to detonators via at least one switching unit which includes a switch and an actuating member for driving the switch. At the end of first excitation, the switch is closed and at the end of second excitation the detonator is blasted via the closed switch.

11 Claims, 5 Drawing Figures

REMOTE BLASTING SYSTEM FOR EFFECTING MULTIPLE-STEP EXPLOSION AND SWITCHING UNIT FOR USE IN THIS SYSTEM

BACKGROUND OF THE INVENTION

The present invention generally relates to a technique for exploding a plurality of explosives in a remote control manner, and more particularly relates to a system for blasting a number of detonators in a multiple-step manner by utilizing electromagnetic induction.

There has been developed a remote blasting system using electromagnetic induction. This system has a simple circuit construction and a stable operation and has been used in place of a usual wired blasting system in which an electric blasting apparatus is connected to detonators by means of conductive wires.

The remote blasting system of the kind mentioned above is described in, for instance, U.S. Pat. No. 3,834,310. This blasting system has been advantageously used for blasting explosives under a deep sea where a strong tide runs.

FIG. 1 shows the known blasting system described in the above patent. The blasting system comprises an oscillating unit 1 including an oscillator 2 and a loop antenna 3 connected to the oscillator 2 and a receiving unit 4 which is connected to a detonator 5 inserted into a main explosive 6. In case of effecting the explosion under the sea, the antenna 3 is first arranged on the sea bottom in such a manner that it encloses an area within which the explosion has to be effected. When a switch 2*a* provided in the oscillator 2 is closed, an A.C. current having a frequency such as 550 Hz is generated from the oscillator 2 and is supplied to the antenna 3. Then an electromagnetic wave is radiated from the antenna 3 toward the receiving unit 4. The receiving unit 4 comprises a coil 7 and a capacitor 8 forming a resonance circuit tuned to the frequency of the A.C. current generated from the oscillator 2. Therefore, due to the electromagnetic wave emitted from the loop antenna 3, in the resonance circuit 7, 8, there is electromagnetically induced an A.C. current. This A.C. current is rectified by a diode 9 and then is charged in an ignition capacitor 10. After the voltage across the ignition capacitor 10 has reached a given threshold value, when the switch 2*a* is opened, the supply of the A.C. current to the loop antenna 2 is stopped abruptly. This change in the induced A.C. current is detected by a driving circuit 11 and the driving circuit 11 operates to close an electronic switch 12 such as a controlled rectifier. Then the ignition capacitor 10 initiates to discharge through the closed switch 12, contacts 4*a*, 4*b* of the receiving unit 4, contacts 5*a*, 5*b* of the detonator 5 connected to the contacts 4*a*, 4*b*, respectively and a fuse head 13 of the detonator 5. In this manner, the detonator 5 is primarily blasted and then the main explosive 6 is secondarily exploded.

In the known blasting system it is possible to explode a plurality of explosives simultaneously. However, in case of effecting the simultaneous explosion on a large scale, there might be produced serious problems such as vibration of the ground, vibration of the air and shock wave in the water. Nowadays, these problems have to be solved in view of the public pollution. In order to avoid such problems, an amount of explosives which are exploded at a time has to be limited. Then the explosion has to be effected several times and this results in an undesired extension of a term of works.

Under the above circumstances there has been practiced a so-called successive or delay explosion in which a plurality of explosives are exploded not simultaneously but intermittently or successively. Heretofore, in case of effecting the delay explosion there are generally used delay type detonators such as MS detonators and DS detonators. However, in case of effecting the underwater explosion, some detonators which should be blasted later are affected seriously by the shock wave produced by the previous explosion. When a detonator is subjected to the explosion shock wave, there might be produced a dangerous situation that a part of explosives might be remained without being exploded due to the dead pressure phenomenon. Further, due to variation in the delay time of the detonators belonging to the same group which should be exploded simultaneously, one or more detonators in the group might not be exploded due to the dead pressure phenomenon. Particularly, in the underwater explosion, since the pressure of the explosion shock wave is hardly decayed in the water, the influence of the dead pressure phenomenon becomes much more serious.

Further, in case of using the delay type detonators, the delay time is fixed and could not be selected at will. Particularly, it is very difficult or almost impossible to set a relatively long delay time.

In the wired explosion, when a plurality of explosives are separated by sufficient distances and use is made of a special blasting device having special circuits by means of which the delay time can be obtained accurately, it will be possible to effect the successive explosion. However, such a system could not be applied to the underwater explosion, because it is quite difficult to arrange the loop antenna under the sea where the strong tide runs.

SUMMARY OF THE INVENTION

The present invention has for its object to provide a novel and useful delay explosion system in which detonators can be successively blasted in a remote control manner due to the electromagnetic induction without using delay type detonators.

It is another object of the invention to provide a delay explosion system in which a delay time can be accurately determined at will in a simple and positive manner.

It is still another object of the invention to provide a delay explosion system which is particularly suitable for effecting the underwater explosion.

According to the invention, in a system for blasting a plurality of detonators in a multiple-step manner from a remote station comprising an oscillating unit for radiating an electromagnetic wave having a given frequency toward an area where the detonators are arranged, and a plurality of receiving units each of which is connected to a respective detonator and includes a resonance circuit tuned to said frequency of the electromagnetic wave, an ignition capacitor charged by an A.C. current induced in said resonance circuit, a trigger circuit for producing a trigger pulse when the radiation of the electromagnetic wave is stopped after the ignition capacitor has been charged sufficiently, and a switch being made conductive by said trigger pulse so as to discharge the ignition capacitor through a detonator connected to a relevant receiving unit, the improvement comprises at least one switching unit which is connected between a receiving unit and a detonator and comprises a switch arranged in a path connecting the receiving unit to the detonator and an actuator section consuming almost all energy stored in the ignition capacitor when the switch of the receiving unit is closed and driving said switch of the switching unit.

The present invention also relates to a switching unit for use in the above blasting system and has for its object to provide a switching unit by means of which a plurality of detonators can be successively blasted at desired time intervals.

According to the invention, a switching unit for use in a system for blasting a plurality of detonators in a multiple-step manner from a remote station comprising an oscillating unit for radiating an electromagnetic wave having a given frequency toward an area where the detonators are arranged, and a plurality of receiving units each of which is connected to a respective detonator and includes a resonance circuit tuned to said frequency of the electromagnetic wave, an ignition capacitor charged by an A.C. current induced in said resonance circuit, a trigger circuit for producing a trigger pulse when the radiation of the electromagnetic wave is stopped after the ignition capacitor has been charged sufficiently, and a switch being made conductive by said trigger pulse so as to discharge the ignition capacitor through a detonator connected to a relevant receiving unit, comprises a pair of input contacts being connectable to a receiving unit;

a pair of output contacts being connectable to a detonator, one of the output contacts being connected to one of the input contacts;

a switch connected between the other input and output contacts; and an actuator section being energized by the charged ignition capacitor when the switch of the receiving unit is closed, and closing said switch of the switching unit, whereby the actuator section is so constructed that the energy stored in the ignition capacitor is almost all consumed for closing the switch of the switching unit.

In a preferred embodiment of the remote blasting system according to the invention, said oscillating means for radiating the controlling electromagnetic wave comprises an oscillator for generating an A.C. current having a given frequency such as 550 Hz and a loop antenna for emitting said electromagnetic wave in response to said A.C. current flowing through said loop antenna. Said receiving means comprises a resonance circuit tuned to the frequency of the electromagnetic wave, an ignition capacitor, a diode for rectifying the induced current and charging the ignition capacitor with the rectified current, a circuit for generating a trigger pulse when the electromagnetic wave is stopped and an electronic switch which is rendered conductive by the trigger pulse so as to discharge the ignition capacitor via the conducted switch.

Further, in a preferred embodiment of the switching unit according to the invention, said actuator section comprises a gas pressure generating member including a fuse head hermetically installed therein, and said switch of the switching unit is driven by an increasing gas pressure generated in said gas pressure generating member when said fuse head is fired by the energy supplied from the igniton capacitor. In such an embodiment, the switch of the switching unit is preferably formed by a double-throw push switch whose actuating rod is driven by the gas pressure generating member.

DESCRIPTION OF THE PREFERRED EMBODIMENTS

Figure 1:
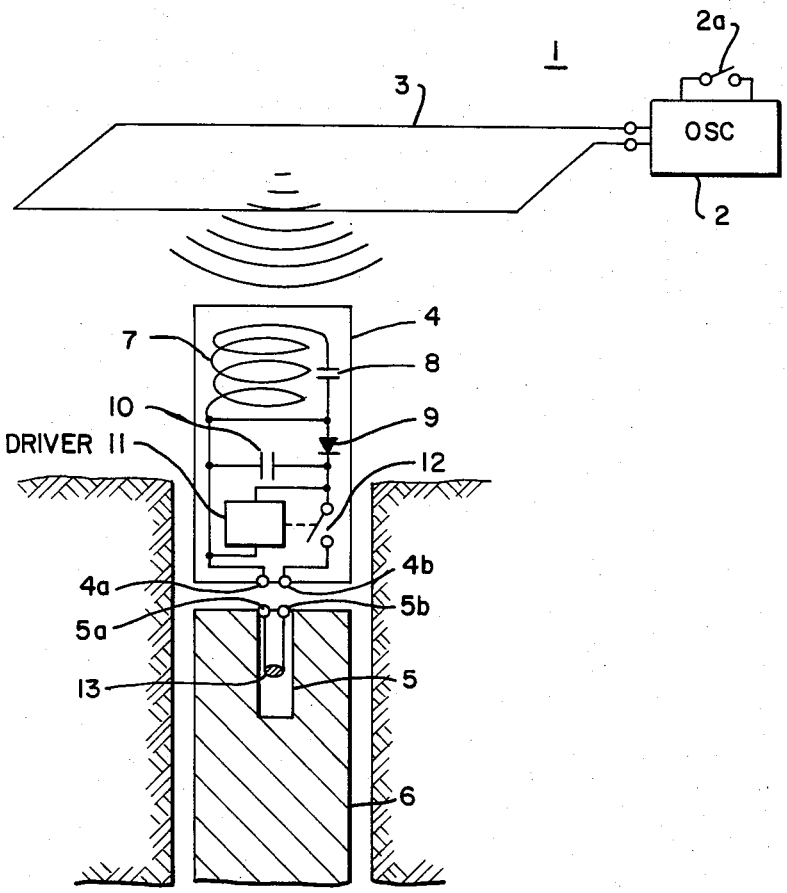
FIG. 1 PRIOR ART
FIG. 1 is a schematic view showing a construction of a known remote blasting system.
Figure 2:
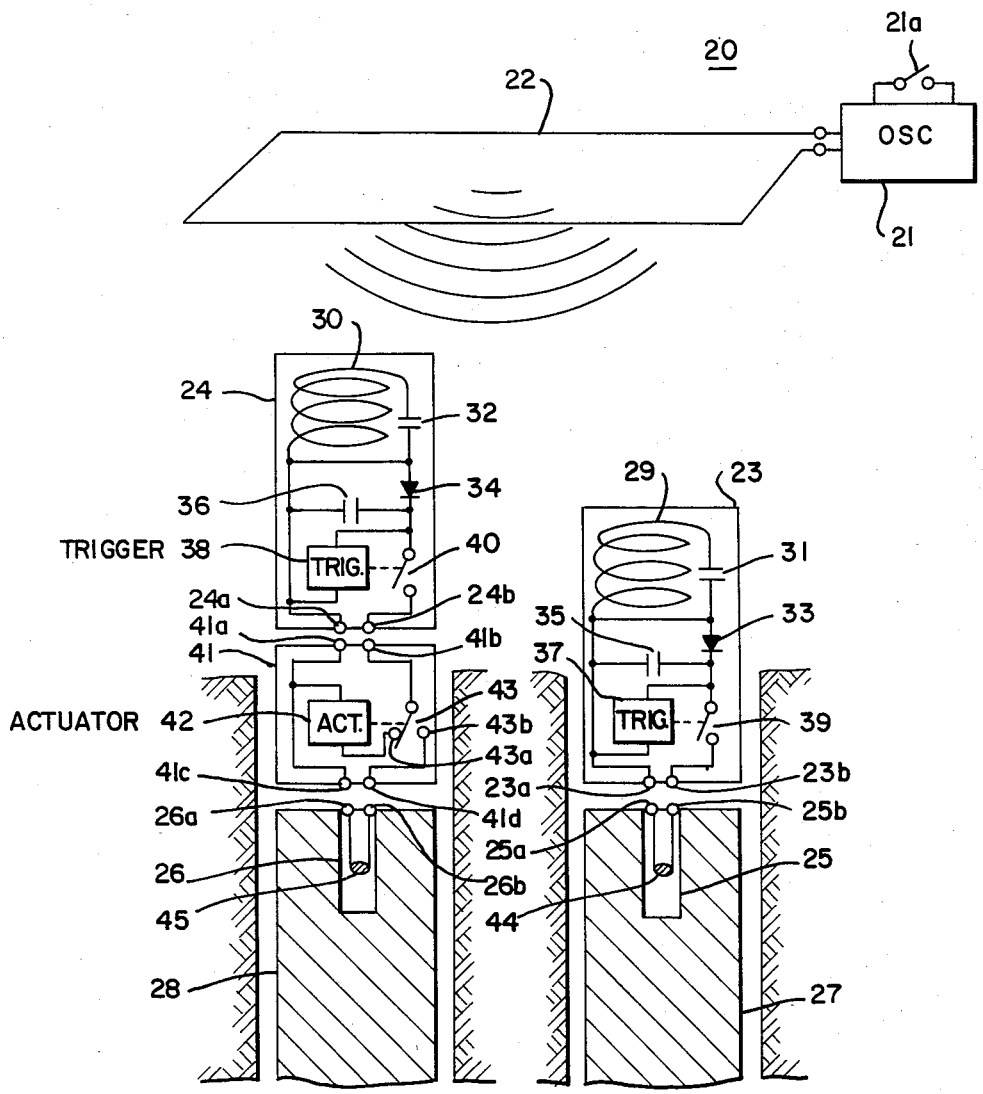
FIG. 2 is a schematic view illustrating an embodiment of the remote blasting system according to the invention.

FIG. 2 shows an embodiment of the remote blasting system according to the invention. The system comprises an oscillating unit 20 which is same as that of the known system illustrated in FIG. 1 and includes an oscillator 21 having an ON-OFF switch 21*a* and a loop antenna 22 connected thereto. The loop antenna 22 is arranged on an area where the delay explosion has to be effected, and emits an electromagnetic wave having a predetermined frequency of, for instance, 550 Hz toward receiving units each connected to detonators. In FIG. 2, for the sake of simplicity there are shown only two receiving units 23, 24 and two detonators 25, 26 coupled with main explosives 27, 28, respectively. The receiving units 23 and 24 have the same construction as that of the known receiving unit 4 shown in FIG. 1, and comprise resonance circuits formed by coils 29, 30 and capacitors 31, 32, respectively and tuned to the frequency of the electromagnetic wave emitted from the loop antenna 22. The receiving units 23 and 24 further comprise diodes 33, 34 for rectifying A.C. currents electromagnetically induced in the resonance circuits upon receiving the electromagnetic energy radiated from the loop antenna 22, ignition capacitors 35, 36 charged by the rectified A.C. currents, electronic circuits 37, 38 generating trigger pulses when the radiation of the electromagnetic wave from the loop antenna 22 is stopped, and electronic switches 39, 40 which are made conductive by the trigger pulses supplied from the electronic circuits 37, 38, respectively.

As shown in FIG. 2, the receiving unit 23 is directly connected to the detonator 25 and contacts 23*a*, 23*b* of the receiving unit 23 are connected to contacts 25*a*, 25*b* of the detonator 25, respectively. Whereas, the receiving unit 24 is coupled with the detonator 26 by means of the switching unit 41. That is to say, contacts 24*a*, 24*b* of the receiving unit 24 are connected to input contacts 41*a*, 41*b* of the switching unit 41, respectively, and output contacts 41*c*, 41*d* of the switching unit 41 are connected to contacts 26*a*, 26*b* of the detonator 26, respectively. The switching unit 41 comprises an actuator section 42 and a double-throw switch 43 whose switching arm is connected to the input contact 41*b* and is driven by the actuator section 42. One of the contacts 43*a* of switch 43 is connected to one input of the actuator section 42 whose other input is directly connected to the input contact 41*a*. The other contact 43*b* of switch 43 is directly connected to the output contact 41*d*. In the position of the switching arm of the switch 43 illustrated in FIG. 2, the input contacts 41*a* and 41*b* are connected to the actuator section 42, but when the switching arm is driven into the contact 43*b* by means of the actuator section 42, the input contacts 41*a*, and 41*b* are connected to the output contacts 41*c* and 41*d*, respectively. It should be noted that the double-throw switch 43 may be formed by a toggle switch, push switch, slide switch or see-saw switch. In these switches once the switching arm is actuated, it could not be returned automatically.

Now the operation of the remote blasting system according to the invention will be explained.

First, the switch 21*a* of the oscillator 21 is closed to radiate the electromagnetic wave from the loop antenna 22. The electromagnetic wave thus radiated is received by the receiving units 23 and 24, simultaneously. Due to the electromagnetic induction, the A.C. currents are generated in the resonance circuits 29, 31 and 30,32 in respective receiving units 23 and 24 and the ignition capacitors 35 and 36 are charged via the rectifiers 33 and 34. After the ignition capacitors 35 and 36 have been sufficiently charged and voltages across the capacitors 35 and 36 have reached predetermined level, the switch 21*a* is opened to stop the radiation of the electromagnetic wave. This interruption of the electromagnetic wave is detected by the electronic circuits 37 and 38 to supply the trigger pulses to the electronic switches 39 and 40. Then these switches 39 and 40 are made conductive temporarily. Then, the charge stored in the ignition capacitor 35 in the receiving unit 23 is discharged through the conducted switch 39, the contacts 23*a*, 23*b*, 25*a* and 25*b*, and a fuse head 44 of the detonator 25. Therefore, the detonator 25 is blasted primarily and then the main explosive 27 is exploded secondarily. In this manner, the explosive 27 can be blasted in the same manner as that explained hereinbefore in connection with FIG. 1.

The operation of the receiving unit 24 is entirely the same as that explained above for the receiving unit 23 and after the ignition capacitor 36 has been sufficiently charged, the switch 40 is made conductive. Then, the charge stored in the ignition capacitor 36 is discharged through the conducted switch 40, the contacts 24*a*, 24*b*, 41*a* and 41*b*, the contact 43*a* of the switch 43 and the actuator section 42. However, the charge stored in the ignition capacitor 36 is not discharged through the detonator 26, because the switching arm of switch 43 is not connected to the contact 43*b*. In this manner, the actuator section 42 is energized by the electrostatic charge energy supplied from the ignition capacitor 36 and the switching arm of switch 43 is driven into the contact 43*b*. It should be noted that the actuator section 42 is so constructed that all the charge stored in the ignition capacitor 36 has been consumed for actuating the switch 43 and after the switching arm has been driven from the contact 43*a* to the contact 43*b*, no charge is remained in the inition capacitor 36. Therefore, even if the switching arm of the switch 43 is driven into the contact 43*b* and the input contacts 41*a*, 41*b* of the switching unit 41 are connected to the output contacts 41*c*, 41*d*, the detonator 26 could never be energized. Further, when the charge in the capacitor 36 is discharged and the voltage thereacross is decreased below a threshold level, the electronic switch 40 in the receiving unit 24 is made non-conductive or cut-off again.

After elapsing a given desired time period, the oscillating unit 20 is energized again to radiate the electromagnetic wave from the loop antenna 22. Then the ignition capacitor 36 is charged again up to the desired level. When the radiation of the electromagnetic wave is stopped by opening the switch 21*a* of the oscillator 21, the electronic switch 40 is made conductive again. Then, the ignition capacitor 36 is discharged through a fuse head 45 of the detonator 26 by means of the conducted switch 40, the contacts 24*a*, 24*b*, 41*a* and 41*b*, the contact 43*b* of the switch 43, and the contacts 41*c*, 41*d*, 26*a* and 26*b*. Therefore, the detonator 26 is primarily blasted and then the main explosive 28 is exploded secondarily.

In the manner explained above, according to the invention, the detonators 25 and 26 can be blasted in a two-step manner by inserting the switching unit 41 between the receiving unit 24 and detonator 26 and by operating the oscillating unit 20 in an intermittent manner. And a time interval between successive explosions is determined by a time interval between the first and second excitation timings of the oscillating unit 20 and can be set at will.

Further, according to the invention, it is possible to take place a multiple-step explosion other than the two-step explosion explained above by suitably selecting the number of the switching units connected between the receiving unit and detonator. This will be further explained hereinbelow.

Figure 3:
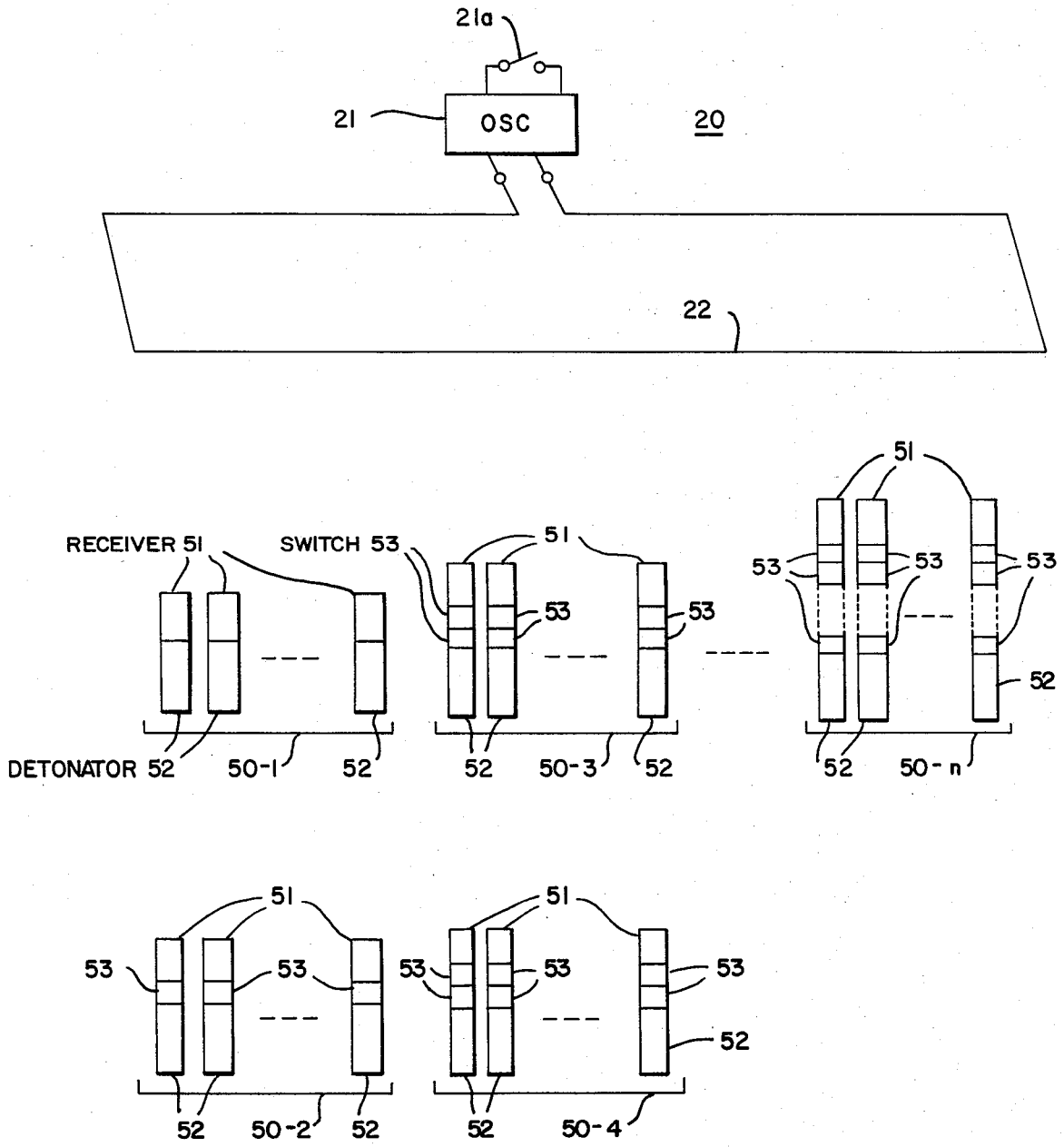
FIG. 3 is a schematic view showing another embodiment of the remote blasting system according to the invention.

FIG. 3 is a schematic view showing the multiple-step explosion system according to the invention. The construction of the oscillating unit 20 is entirely the same as that illustrated in FIG. 2. According to the invention, the area within which the delay explosion is to be effected is divided into a plurality of blocks 50-1, 50-2 . . . 50-*n*. In a first block 50-1, there are arranged one or more detonating sets each of which is formed by a receiving unit 51 and a detonator 52 directly connected to the receiving unit 51. In the second block 50-2, there are also provided one or more detonating sets, each being formed by a receiving unit 51, a detonator 52 and a switching unit 53 inserted between the receiving unit 51 and detonator 52. In the third block 50-3, there are arranged a desired number of detonating sets, each of which is constructed by a receiving unit 51, a detonator 52 and two switching units 53 connected in series between the receiving unit 51 and detonator 52. Similarly, in nth block 50-*n*, there are provided one or more detonating sets each formed by a receiving unit 51, a detonator 52 and $n-1$ switching units 53 connected in series between the receiving unit 51 and detonator 52. All the receiving units 51 are so constructed that they are tuned to the frequency of the electromagnetic wave radiated from the loop antenna 22.

After generating the electromagnetic wave from the loop antenna 22 for a given time period, when the switch 21*a* of the oscillator 21 is opened, the ignition capacitors in all the receiving units 51 are discharged through the conducted switches therein. Therefore, all the detonators 52 in the first block 50-1 are blasted, but the detonators in the remaining blocks 50-2, to 50-*n* are not blasted. However, the actuator sections in switching units 53 which are directly connected to the receiving units 51 are all actuated and the switches in these switching units are actuated. However, the switches in the remaining switching units in the blocks 50-2 to 50-*n* are not actuated. Therefore, when the oscillating unit 20 is operated in a second time, the detonators 53 in the second block 50-2 are exclusively blasted. At the same time, the switches in next following switching units in the blocks 50-3 to 50-*n* are actuated. When the oscillating unit 20 is energized in a third time, only the detonators 52 belonging to the third block 50-3 are selectively blasted. In this manner, the detonators of the successive blocks can be successively blasted each time the oscillating unit 20 is energized for the given time period.

According to the invention, it is important that the actuator section 42 of the switching unit 41, shown FIG. 2 is positively operated to drive the switching arm of switch 43 from the contact 43*a* to the contact 43*b* and after that there is not remained at all any charge in the ignition capacitor 36 of the receiving unit 24. That is to say, the charge stored in the ignition capacitor 36 is completely consumed by the actuator section 42 within a short time.

According to the invention, the switching unit 41 may be formed in various constructions as long as the above explained condition is satisfied. For instance, the switching unit may be constructed by an electromagnetic switch having a relay circuit installed therein or by a usual relay switch.

Figure 4:
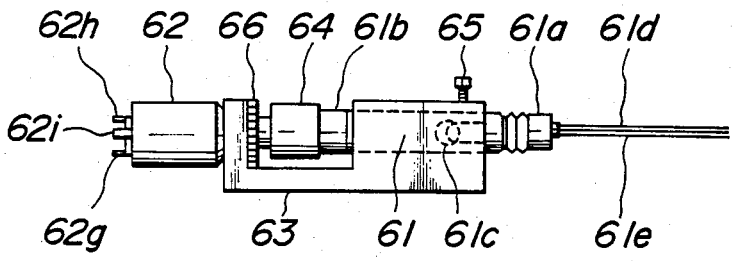
FIGS. 4 and 5 show an embodiment of the switching unit according to the invention.
Figure 5:
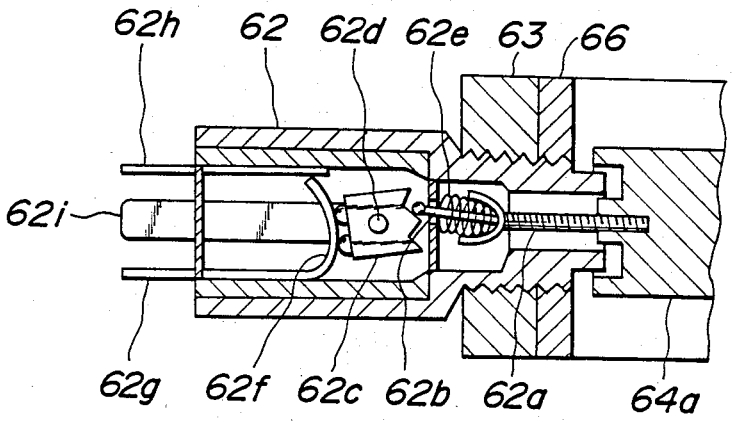

FIGS. 4 and 5 are front and sectional views illustrating an embodiment of the switching unit according to the invention. In the present embodiment, the switching unit comprises a gas pressure generating member 61 and a push switch 62 actuated by a gas pressure produced by the gas pressure generating member 61. The gas pressure generating member 61 and push switch 62 are coupled with each other by means of a frame 63 made of alminum, while a pusher member 64 is inserted therebetween. That is to say, one end of the frame 63 is secured to the gas pressure generating member 61 by means of a screw 65 and the other end of the frame 63 is connected to the push switch 62 with the aid of a ring screw 66. The gas pressure generating member 61 comprises a cylindrical tube whose both end openings are closed in an air tight manner with plugs 61*a* and 61*b*. In the tube there is arranged a fuse head 61*c* which is connected to conductors 61*d* and 61*e* extending through the plug 61*a*. It should be noted that the plug 61*b* is so secured to the tube that it is positively removed from the tube when the fuse head 61*c* is exploded. As shown in FIG. 5, the pusher member 64 comprises a pushing element 64*a* which is connected to one end of a rod 62*a* of the push switch 62, to the other end of the rod 62*a* being further connected an actuator pin 62*b* which is engaged with a rotary member 62*c* rotatable about a shaft 62*d*. There is further provided a coiled spring 62*e* around the actuator pin 62*b* so that the actuator pin is biased rightward. The push switch 62 comprises a switching plate 62*f* made of resilient metal sheet and is connected to a contact pin 62*g*. The switching plate 62*f* serves as the switching arm and is selectively connected to contacts (not shown) which are connected to lead pins 62*h* and 62*i*. It should be noted that in an initial state, the switching plate 62*f* is connected to the lead pin 62*h*.

When a current is supplied to the fuse head 61*c* of the gas pressure generating member 61 via the conductors 61*d* and 61*e*, the fuse head 61*c* is blasted and the pressure inside the gas pressure generating member is incrased abruptly. Then the plug 61*b* is expelled out of the gas pressure generating member 61 and thus the pushing element 64*a* of the pusher member 64 is moved leftward. Therefore, the actuator pin 62*b* of the push switch 62 is also moved leftward against the force of the coiled spring 62*e* to rotate the rotary member 62*c* in the counter clockwise direction. Then the switching plate 62*f* is disconnected from the lead pin 62*h* and is connected to the lead pin 62*i*. Although the actuator pin 62*b* is returned rightward due to the force of the coiled spring 62*e*, the rotary member 62*c* is not rotated in the clockwise direction due to the spring force of the switching plate 62*f*. That is to say, the push switch 62 serves as a kind of the toggle switch. In this manner, the push switch 62 can be actuated only once and after the push switch 62 has been actuated, its switching arm could not be driven any more. It is apparent that when the switching unit shown in FIGS. 4 and 5 is used in the system shown in FIG. 2, the conductor 61*d* is commonly connected to the input and output contacts 41*a* and 41*c*, the conductor 61*e* is connected to the contact 43*a* of the switch 43, i.e. the lead pin 62*h* of the push switch 62, and the lead pins 62*g* and 62*i* are connected to the input contact 41*b* and the output contact 41*d*, respectively.

Now experimental examples of the remote blasting system according to the invention will be explained.

EXAMPLE 1

In this example, the switching units shown in FIGS. 4 and 5 were used. As the receiving units, use was made of NISSAN BLASTER-LB-4W (trade name) manufactured and sold by Nippon Oils & Fats Co., Ltd. The loop antenna formed by three turns of a wire conductor having a cross sectional area of 46 $mm^2$ was arranged on the ground in a rectangular shape having a dimension of 80 m×90 m. An area surrounded by the loop antenna was divided into two blocks and in each block there were arranged ten detonators. The detonators in the first block were directly connected to the receiving units and each detonators in the second block were connected to the receiving units via respective switching units. As the oscillating unit use was made of a NISSAN Remote Control Blasting Unit A-III (trade name) manufactured and sold by Nippon Oils & Fats Co., Ltd.

After effecting the primary oscillation for sixty seconds, when the oscillating unit was deenergized, all the ten detonators in the first group to which no switching unit was connected were blasted simultaneously, but the ten detonators in the second group to which the switching units were connected were not blasted at all. Next, after a secondary oscillation was carried out also for sixty seconds, the oscillator was stopped. Then all the ten detonators in the second block were exploded simultaneously.

The above experiment was conducted ten times and the same result was always obtained.

A swithcing time of the pusher switch in the switching unit was 1.7 to 2.0 mS after the oscillation was stopped.

EXAMPLE 2

The same oscillating unit and loop antenna were used as those of the first example 1. In the second example, the area surrounded by the loop antenna was divided into three blocks. In a first block there were arranged five detonators which were directly connected to respective receiving units, in a second block there were provided five detonators each of which was connected to a receiving unit via one switching unit, and in a third block there were also arranged five detonators each connected to respective receiving unit via two switching units which were connected in series. Then primary, secondary and tertiary oscillations were carried out successively with suitable intervals. The detonators were exploded in a manner represented by the following table.

TABLE

| Block | Oscillation | Test No. 1 Primary | Test No. 1 Secondary | Test No. 1 Tertiary | Test No. 2 Primary | Test No. 2 Secondary | Test No. 2 Tertially |
|---|---|---|---|---|---|---|---|
| | 1 | 5/5 | — | — | 5/5 | — | — |
| | 2 | 0/5 | 5/5 | — | 0/5 | 5/5 | — |
| | 3 | 0/5 | 0/5 | 5/5 | 0/5 | 0/5 | 5/5 |

Note:
Denominator = Total Number of Detonators
Numerator = Number of Blasted Detonators From the above table, it is clear that according to the invention it is possible to effect the delay explosion in a multiple-step manner by selectively connecting the switching units between the detonators and receiving units. According to the invention, the interval between successive explosions, i.e. delay time is determined by the interval between successive energizing operations of the oscillating unit and thus can be set at will even though the same kinds of detonators, the same kinds of receiving units and the same kinds of switching units are used. Therefore, it is possible to perform the delay explosion in a positive, safe and accurate manner. Further, since the detonators can be blasted in a remote control manner, the underwater explosion can be effected easily. It is a matter of course that the remote blasting system according to the invention can be also advantageously carried out not only in the water, but also on the ground.

What is claimed is:

1. In a system for blasting a plurality of detonators in a multiple-step manner from a remote station comprising an oscillating unit for radiating an electromagnetic wave having a given frequency toward an area where the detonators are arranged, and a plurality of receiving units each of which is connected to a respective detonator and includes a resonance circuit tuned to said frequency of the electromagnetic wave, an ignition capacitor charged by an A.C. current induced in said resonance circuit, a trigger circuit for producing a trigger pulse when the radiation of the electromagnetic wave is stopped after the ignition capacitor has been charged sufficiently, and a switch being made conductive by said trigger pulse so as to discharge the ignition capacitor through a detonator connected to a relevant receiving unit, the improvement comprising at least one switching unit which is connected between a receiving unit and a detonator and comprises a switch arranged in a path connecting the receiving unit to the detonator and an actuator section consuming almost all energy stored in the ignition capacitor when the switch of the receiving unit is closed and driving said switch of the switching unit.

2. A system according to claim 1, wherein different numbers of switching units are connected in series between receiving units and detonators to effect the explosion in more than two steps.

3. A system according to claim 1, wherein said actuator section is energized by the ignition capacitor via the switch of the switching unit.

4. A system according to claim 1, wherein said actuator section comprises a gas pressure generating member having a fuse head hermetically installed therein, whereby said fuse head is fired by the energy supplied from the ignition capacitor to increase a gas pressure and said switch of the switching unit is actuated by the increased gas pressure.

5. A system according to claim 4, wherein said switch of the switching unit is formed by a double-throw push switch and said gas pressure generating member includes a plug which is expelled out of the gas pressure generating member when the fuse head is fired, whereby an actuator of the push switch is driven by said expelled plug.

6. A switching unit for use in a system for blasting a plurality of detonators in a multiple-step manner from a remote station comprising an oscillating unit for radiating an electromagnetic wave having a given frequency toward an area where the detonators are arranged, and a plurality of receiving units each of which is connected to a respective detonator and includes a resonance circuit tuned to said frequency of the electromagnetic wave, an ignition capacitor charged by an A.C. current induced in said resonance circuit, a trigger circuit for producing a trigger pulse when the radiation of the electromagnetic wave is stopped after the ignition capacitor has been charged sufficiently, and a switch being made conductive by said trigger pulse so as to discharge the ignition capacitor through a detonator connected to a relevant receiving unit, comprising a pair of input contacts being connectable to a receiving unit;

a pair of output contacts being connectable to a detonator, one of the output contacts being connected to one of the input contacts;

a switch connected between the other input and output contacts; and an actuator section being energized by the charged ignition capacitor when the switch of the receiving unit is closed, and closing said switch of the switching unit, whereby the actuator section is so constructed that the energy stored in the ignition capacitor is almost all consumed for closing the switch of the switching unit.

7. A switching unit according to claim 6, wherein said switch of the switching unit is formed by a double-throw switch having a switching arm connected to the other input contact, a first switch contact connected to the actuator section and a second switch contact connected to said other output contact, whereby in an initial condition the switching arm is connected to the first switch contact, and when the actuator section is operated, the switching arm is driven from the first switch contact into the second switch contact, and after that the switching arm is remained into the second switch contact.

8. A switching unit according to claim 7, wherein the switch of the switching unit is formed by a double-throw push switch having a pushing element coupled with the switching arm.

9. A switching unit according to claim 6, wherein said actuator section comprises a gas pressure generating member including a fuse head hermetically installed therein, and said switch of the switching unit is driven by an increasing gas pressure generated in said gas pressure generating member when said fuse head is fired by the energy supplied from the ignition capacitor.

10. A switching unit according to claim 9, wherein said gas pressure generating member comprises a cylindrical tube and a pair of plugs fit into respective end openings of the tube to form a hermetically sealed space in which said fuse head is arranged, and one of the plugs is arranged opposite to an actuator element of the switch of the switching unit.

11. A switching unit according to claim 10, wherein said switch is formed by a double-throw push switch and the push switch is mechanically coupled with the gas pressure generating member by means of a frame.

* * * * *